United States Patent [19]

Godfrey et al.

[11] 4,091,870

[45] May 30, 1978

[54] METHOD FOR GENERATING HORIZONTAL FRACTURES IN A WELLBORE

[75] Inventors: Charles S. Godfrey; E. T. Moore, Jr., both of Berkeley, Calif.

[73] Assignee: Physics International Company, San Leandro, Calif.

[21] Appl. No.: 735,676

[22] Filed: Oct. 26, 1976

[51] Int. Cl.[2] ..... E21B 43/26

[52] U.S. Cl. ..... 166/299; 102/23; 166/63; 102/DIG. 2

[58] Field of Search ..... 166/299, 63, 308; 102/20, 21, 22 R, 23, DIG. 2; 299/13

[56] References Cited

U.S. PATENT DOCUMENTS

| | | | |
|---|---|---|---|
| 2,775,940 | 1/1957 | Klotz, Jr. | 102/23 |
| 3,002,454 | 10/1961 | Chesnut | 166/308 |
| 3,457,859 | 7/1969 | Guenter | 102/22 |
| 3,637,020 | 1/1972 | McLamore | 166/299 X |
| 3,863,987 | 2/1975 | Lampard | 166/299 X |

*Primary Examiner*—Stephen J. Novosad

*Attorney, Agent, or Firm*—Lindenberg, Freilich, Hornbaker, Wasserman, Rosen & Fernandez

[57] ABSTRACT

A method for generating a horizontal fracture through a wellbore by causing two explosively induced shear waves to intersect. This is achieved by placing, within a coupling fluid within a wellbore, a length of high explosives whose center is adjacent the location where a fracture is desired. Both ends of the high explosive are ignited simultaneously.

6 Claims, 7 Drawing Figures

METHOD FOR GENERATING HORIZONTAL FRACTURES IN A WELLBORE

BACKGROUND OF THE INVENTION

This invention relates to a method and means for stimulating the production of wells by fracturing the wellbore at a predetermined location.

The advantages of a horizontal fracture in an oil or gas-bearing reservoir have been pointed out by various authors. This is especially true for low permeability formations. For example, in a paper, SPE3010, entitled "Low Permeability Gas Reservoir Production Using Large Hydraulic Fractures," by Holditch, et al. presented by the 45th annual fall meeting of this society of Petroleum Engineers of AIME, in 1970, it was shown that in a formation such as the "Pictured Clips" (0.02md) having a formation pressure of 800 psi and a fracture capacity of 3md-ft, the productivity of 100 foot horizontal fracture would be approxmately six times greater than the productivity from a single thousand foot vertical fracture. Another example was analyzed and presented in a paper by Howard et al., entitled *Hydraulic Fracturing,* Volume 2, Henry L. Doherty Memorial Fund of AIME, Society of Petroleum Engineers of AIME, N.T. and Dallas (1970). It was shown for a much higher permeability formation (0.2md) with an extended pressure of 1700 psi and a fracture capacity of 150 md-ft showed that a 200 foot horizontal fracture was approximately 1½ times more productive than a 200 foot vertical fracture.

OBJECTS AND SUMMARY OF THE INVENTION

An object of this invention is to provide a novel method for explosively creating a substantially horizontal fracture in rock having a predetermined radiation pattern at a predetermined location.

Still another object of this invention is the provision of a method for creating a substantially radial horizontal fracture in the rock formation of a borehole, using simpler techniques than heretofore used.

The foregoing and other objects of this invention may be achieved by explosively generating two shear waves which travel towards one another. Where these two shear waves intersect, they cause tensile fractures. This is performed in a wellbore by filling the well above the level of the payzone wherein a horizontal fracture is desired, with a coupling fluid. A cylinder of a high explosive is suspended within the wellbore with the center thereof located adjacent the region at which a horizontal fracture is desired. The well may be capped at the surface of the coupling fluid. The cylinder of explosive is ignited simultaneously, at its opposite ends. The detonations created travel towards one another at a rate which is determined by the type of explosive. Since the high explosives used is of the same type throughout, the detonations travel from opposite ends towards each other at the same rate. Where they intersect, a radial horizontal fracture is generated in the rock formations of the wellbore.

DESCRIPTION OF THE PREFERRED EMBODIMENTS

Figure 1:
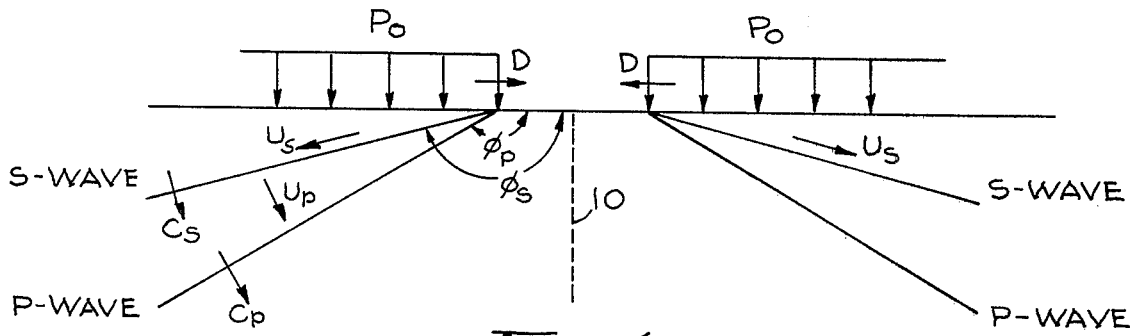
FIG. 1 and FIG. 2 are wave configuration drawings, illustrating in planar geometry the wave configuration which occurs before shear wave intersection and after shear wave intersection.

In FIG. 1, in planar geometry, there is represented two loads, each one having the value of P*o*, which are moving toward each other across an elastic half space, with a velocity, D, greater than the compressive wave speed in the medium. For a step load, P*o*, that is sufficiently below some elastic limit of the medium, $P_e$, the solution of the wave equations will be elastic and similar to those shown graphically in FIG. 1. In response to each load, two distinct and constant stress regions are generated by the compressive or P-wave, moving with the velocity $C_p$, and the shear wave or S-wave moving with the velocity $C_s$.

Figure 2:
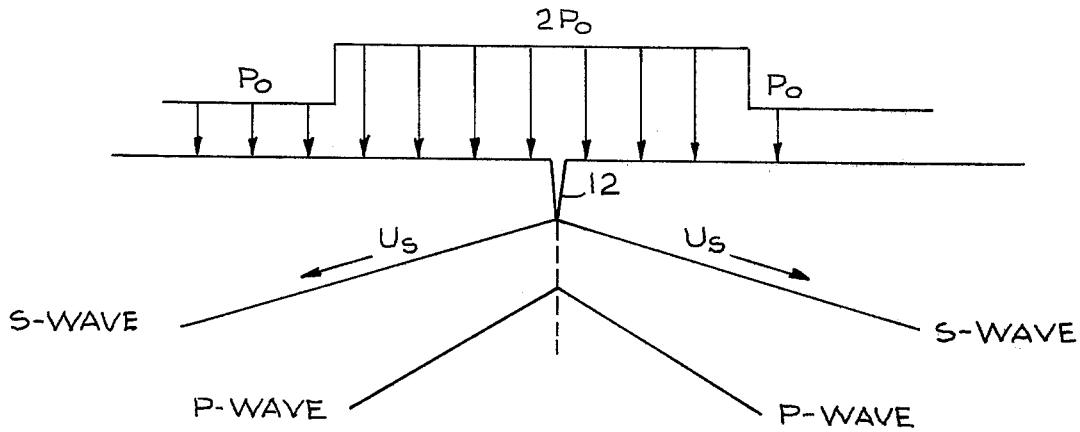

The orientation of these waves with the surface of the media is given by $\phi_P = \pi - \sin^{-1}(C_p/D)$, and $\phi_s = \pi - \sin^{-1}(C_s/D)$ respectively. However, the distinguishing difference between these waves is the fact that the particle velocity, $U_p$, behind the compression wave, is parallel to the waves direction of motion while the particle velocity, $U_s$, behind the shear wave, is perpendicular to the waves direction of motion. It can therefore be postulated that if the two identical loads were approaching each other in a real, elastic-plastic media, the equal but oppositely directed particle motion behind their shear waves can cause tensile fracture of the rock at the point of intersection. This is shown schematically in FIG. 2 where the point of intersection indicated by the dotted lines 10, in FIG. 1 has a fracture 12 at that location when the intersection of the two shear waves occurs.

It should be noted that the wave configurations as described above are valid only if P*o* is less than $P_e$ and are presented only to illustrate the concept of using intersecting shear waves to cause tensile fracture at predetermined locations.

Figure 3:
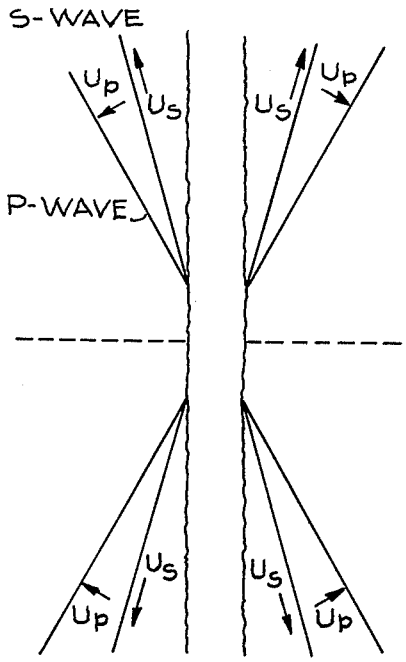
FIGS. 3 and 4 are illustrative drawings of wave configurations, before shear wave intersection and after shear wave intersection, which occur with cylindrical geometry.
Figure 4:
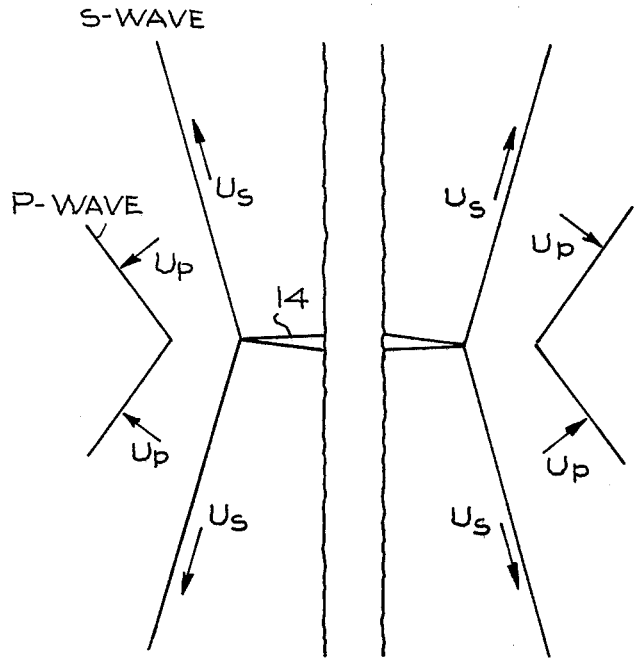

FIGS. 3 and 4 illustrate respectively the locations of the P-waves and S-waves in a cylindrical geometry, before shear wave intersection and after shear wave intersection. It will be noted in FIG. 4, that a fracture 14 occurs at the intersection of the shear waves.

Different wave patterns are obtained when the velocity of the load is less than the compressive wave velocity but greater than the shear wave velocity. This is known as transeismic loading. The kind of loading illustrated in FIGS. 1–4 is known as superseismic loading, which occurs when the velocity of the load is greater than the compressive wave velocity and shear wave velocity. Another type of loading which can be used is sub-seismic loading. This occurs when the velocity of the load is less than the compressive wave velocity and less than the shear wave velocity. The type of loadings which are preferred, in accordance with this invention, are superseismic and transeismic loading.

In order to determine what the compressive wave speed is in a medium, in order to determine the velocity required for the load, to achieve superseismic or transeismic loading, if that information is not provided in the literature for the particular type of rock strata in which it is desired to use this invention, one may conduct seismic tests, in well-known manner by detonating an explosive charge and measuring, also in manner well-known to those who conduct seismic tests, the compressive wave speed in the rock formation, in which it is desired to employ this invention.

A preferred method of practicing the invention requires a knowledge of the pressure required for crushing the rock formation of a borehole. It is preferred to use a quantity of explosive which will not crush the rock formation. Accordingly, the amount of explosive to be used is preferably that amount which produces a compressive load just below the compressive load required for crushing the rock.

Figure 5:
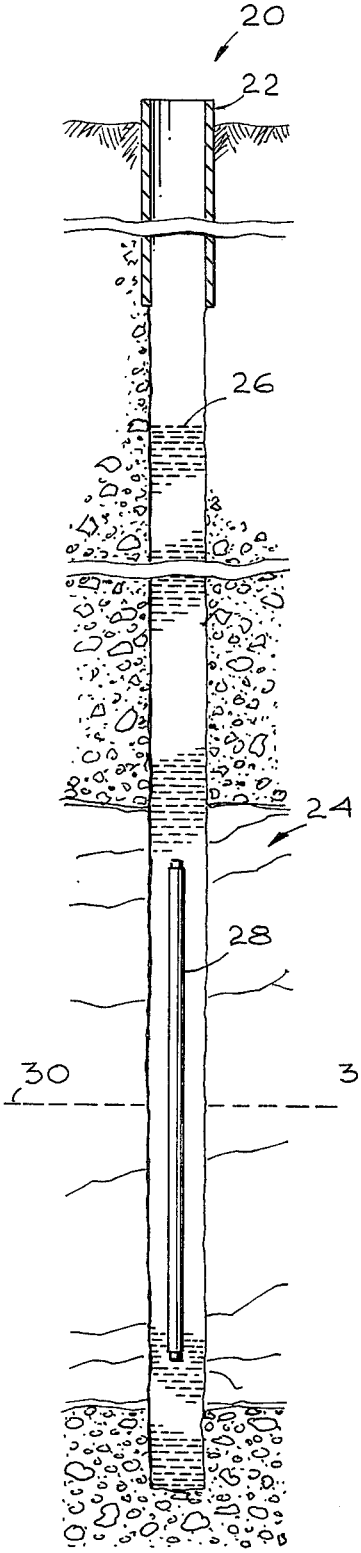
FIG. 5 is a cross sectional view of a wellbore illustrating, in accordance with this invention, the placement of explosives therein.

FIG. 5 shows how the invention may be practiced in a wellbore. The wellbore 20 will have the casing 22 extending until just above the region of the payzone 24. The wellbore is filled with a coupling fluid 26 to a level above the payzone. A high explosive 28, in the form of a cylinder, is suspended in position at the payzone, with the center of the cylinder of high explosive adjacent to the region of the wellbore at which a horizontal fracture is desired. The center plane is represented in FIG. 5 by the dotted lines 30. The wellbore may be capped at the top of the coupling fluid in well-known manner, if desired.

From the seismic information which indicates at what velocity the high explosive detonation should travel, those skilled in the art can select the kind of high explosive that is required. Detonation velocity information is given by the manufacturers of the high explosives. From the information as to the compressive strength of the rock formation at the payzone, one can determine the diameter of the cylinder of explosive. The diameter of the high explosive and the type of explosive used determines the pressure load which is applied to the rock formation. The length of the explosive cylinder is such that the shear waves build up and approach their steady-state condition before they interact. Those skilled in the art can determine the dimensions of the cylinder of explosive so that the pressure load is less than the pressure required to crush the rock and the shear waves approach steady-state. Both ends of the cylinder explosive are ignited simultaneously by well-known techniques which include using a detonator at each end of the cylinder explosive. These detonators are connected by suitable wires to the source of current which causes them to be detonated.

Figure 6:
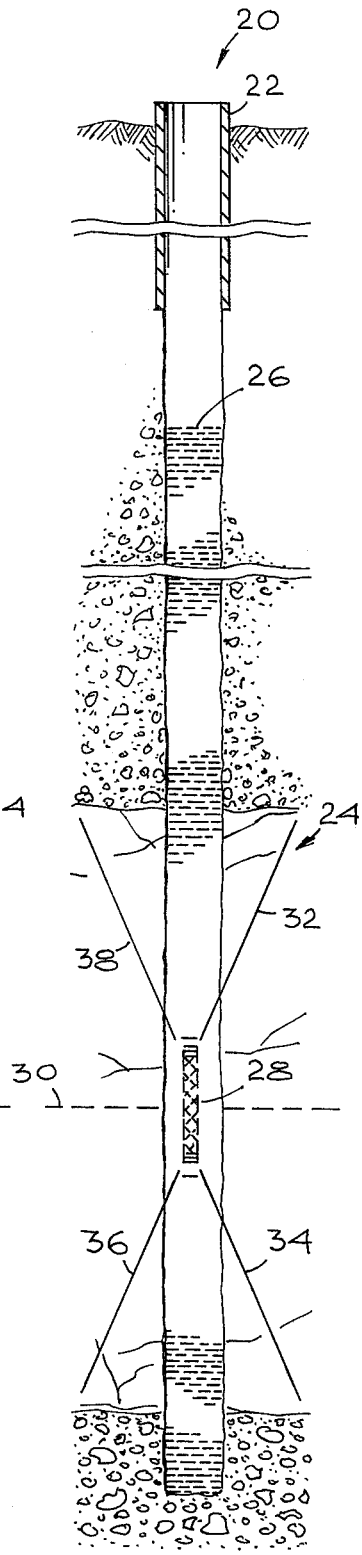
FIG. 6 is a cross sectional schematic view illustrating what happens during detonation.

FIG. 6 illustrates what is happening during detonation. The cylinder of explosive causes pressure waves in the coupling fluid which in turn cause the shear waves represented by the solid lines respectively 32, 34, 36 and 38. The shear waves appear to emanate from the ends of the detonated high explosive.

Figure 7:
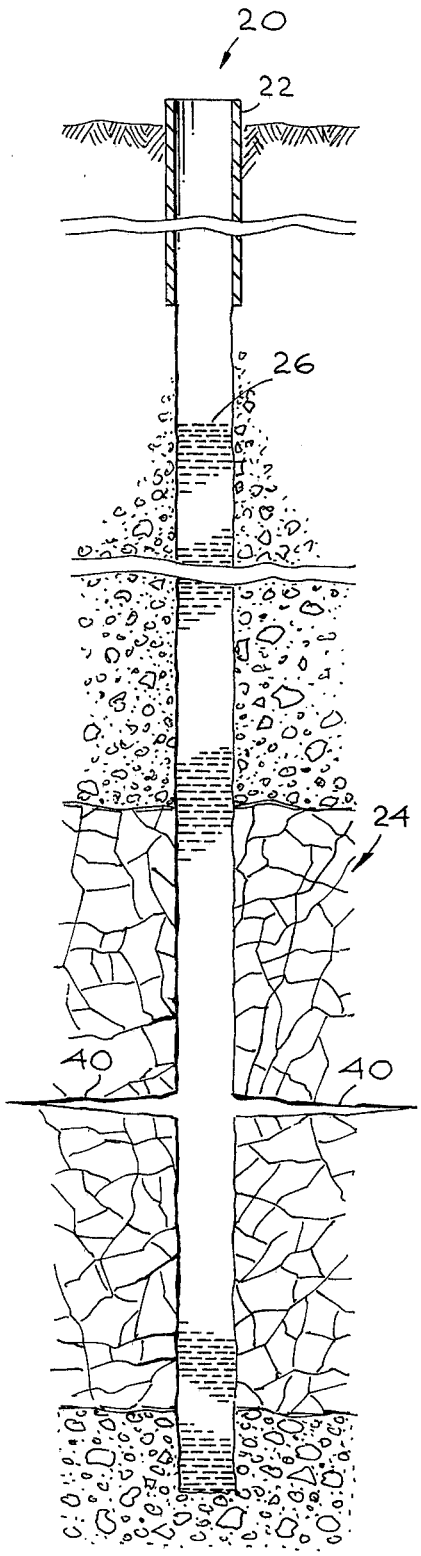
FIG. 7 is a cross sectional view illustrating a wellbore after detonation has occurred in accordance with this invention.

FIG. 7 represents the appearance, in cross-section, of the borehole 20, after the approaching shear waves, 32, 34, 36 and 38 have intersected. The horizontal fracture 40, which effectively is a radial planar fracture, has been caused by the intersecting shear waves.

Accordingly, there has been described hereinabove a novel, useful and relatively inexpensive method for producing a substantially horizontal fracture in the rock formation of a borehole. While the invention has been explained and illustrated as creating a horizontal fracture in a borehole this invention should not be considered as limited to such use. It can be used for opening fractures where the gasification of coal seams is desired or where in situ solution mining, or in situ coal gasification is desired.

We claim:

1. A method for producing a substantially planar fracture, at a desired location in a borehole formation which extends outwards from a borehole in a plane substantially perpendicular to said borehole, without appreciable crushing of said formation, the steps comprising:

filling said borehole with a coupling fluid to a level above said desired location, suspending high explosive in the form of a cylinder within said borehole, said cylinder being substantially perpendicular to the plane in which the fracture is to be formed, with the center of the length dimension of said cylinder of high explosive adjacent to said desired location, and simultaneously igniting both ends of said cylinder of high explosive whereby the detonations caused by the ignition of both ends of said cylinder intersect, a substantially planar fracture is established in the borehole formation, the dimensions of said cylinder and the explosives being chosen to provide a compressive load to said formation, which is less than the compressive load required to crush said formation, and to provide a detonation velocity which exceeds the velocity of shear waves through said formation.

2. A method as described in claim 1 wherein the length of said cylinder of explosive is chosen so that the shear waves approach their steady state condition before they interact substantially at said formation location.

3. A method of producing a planar fracture at a desired location in a rock formation without any appreciable crushing of the rock formation, the steps comprising:

positioning explosives of preselected dimensions in a plane perpendicular to the plane in which said fracture is to be formed with the center of said explosives aligned with said location, the dimensions and explosives being selected to produce a load velocity which is greater than the shear velocity; and simultaneously igniting opposite ends of said explosives, to detonate said explosives, whereby the detonation results in the production of said planar fracture as a result of the interaction of shear waves, generated by the simultaneous ignition of the opposite ends of said explosives.

4. A method as described in claim 3 wherein the opposite ends of said explosives are spaced apart so that the shear waves approach their steady state condition before they interact substantially at said formation location.

5. A method as described in claim 3 wherein a borehole extends through said formation in a direction perpendicular to the plane in which the fracture is to be formed and the explosives are located in said borehole, further including the step of filling said borehole with a coupling fluid to a level so as to cover the upper end of said explosives.

6. A method as described in claim 5 wherein the opposite ends of said explosives are spaced apart so that the shear waves approach their steady state condition before they interact substantially at said formation location.

* * * * *